US006736868B2

(12) United States Patent
Flaynik, Jr. et al.

(10) Patent No.: US 6,736,868 B2
(45) Date of Patent: May 18, 2004

(54) METHOD FOR IMPARTING ANTI-STATIC CHARACTERISTICS TO NON-CONDUCTIVE FLUIDS

(76) Inventors: Donald G. Flaynik, Jr., 24605 S. Ford Rd., Channahon, IL (US) 60410; Michael R. Colburn, 1307 Trembath La., Antioch, CA (US) 94509

( * ) Notice: Subject to any disclaimer, the term of this patent is extended or adjusted under 35 U.S.C. 154(b) by 0 days.

(21) Appl. No.: 10/086,064

(22) Filed: Feb. 27, 2002

(65) Prior Publication Data

US 2003/0046863 A1 Mar. 13, 2003

Related U.S. Application Data

(60) Provisional application No. 60/318,787, filed on Sep. 12, 2001.

(51) Int. Cl.[7] ..... C10L 1/12; C10L 1/18

(52) U.S. Cl. ..... 44/457; 44/437; 44/439; 44/451

(58) Field of Search ..... 44/457, 437, 439, 44/451

(56) References Cited

U.S. PATENT DOCUMENTS

| | | | | | |
|---|---|---|---|---|---|
| 3,674,450 | A | * | 7/1972 | Filachek et al. | 44/363 |
| 3,758,283 | A | * | 9/1973 | Matt | 44/366 |
| 3,951,613 | A | * | 4/1976 | Kiele | 110/344 |
| 3,955,938 | A | * | 5/1976 | Graham et al. | 44/305 |
| 4,336,148 | A | * | 6/1982 | Wirth et al. | 508/136 |
| 4,515,603 | A | * | 5/1985 | Knepper et al. | 44/440 |
| 5,672,183 | A | * | 9/1997 | Schield | 44/386 |
| 6,031,039 | A | * | 2/2000 | Koppen | 524/495 |

* cited by examiner

*Primary Examiner*—Cephia D. Toomer
(74) *Attorney, Agent, or Firm*—Cherskov & Flaynik

(57) ABSTRACT

A method for imparting anti-static characteristics to fuel is provided, the method comprising supplying a hydrocarbon fuel and mixing the fuel with an ion, contained in an inorganic compound, to reduce the electrical resistance of the fuel.

17 Claims, 2 Drawing Sheets

METHOD FOR IMPARTING ANTI-STATIC CHARACTERISTICS TO NON-CONDUCTIVE FLUIDS

This application is based on U.S. Provisional Application No. 60/318,787 filed on Sep. 12, 2001.

BACKGROUND OF THE INVENTION

1. Field of the Invention

The present invention relates to a method and a compound for imparting anti-static characteristics to non-conductive fluids, and more particularly, this invention relates to a method and an additive for reducing and/or eliminating electrostatic charge build-up in non-conductive fluids stored in a container or flowing through a conduit.

2. Background of the Invention

Non-conductive hydrocarbon fuels are the most common fluids utilized to generate Power. These hydrocarbon fuels include, but are not limited to, gasoline, diesel fuel and jet fuel.

A hydrocarbon fuel flowing through a conduit accumulates static charge due to impurities in the fluid or due to friction whereby electrons are sheared from molecules by adjacent molecules or by engine conduit components, resulting in localized pockets of charge in the fuel. These phenomena are referred to as "Flow-Charging", "Contact Electrification" and "Charge Separation."

FIG. 1 depicts the phenomenon of fuel charging, generally designated as numeral 10. In this scenario, fuel 12 having ionic impurities 13 is shown. When the fuel is at rest (FIG. 1A), the impurities adsorb at the interface between the fuel and a surface, such as a pipe wall 14. One part of the fuel (either a positive or a negative ionic component) has a stronger affinity for the wall 14 than the fuel. If the conduit is comprised of metal, the negative portion of the fuel 12 is more attracted to the wall 14 as noted in FIG. 1A. (It should be noted, however, that a wall comprised of a different material may attract positive-ion components of any fuel impurities.)

Once the fuel begins to travel through the conduit 14 (in the direction of the arrow in FIG. 1B), the wall-adsorbed negative ions are left behind. The resulting flowing fuel has a positive charge. The negative charge imparted to the conduit wall 14 is shunted to ground 16

The loci of static charge which accumulate in a flowing hydrocarbon fuel, and the formation of these charges, are impacted by the velocity of fuel flow, the size of the fuel conduit, the dissimilar materials comprising the fuel handling systems (i.e.; metal, plastic, composites and/or elastomers), operating characteristics and componentry of fuel filters and fuel pumps, and the viscosity, temperature and type of fuel. These pockets of static charge can reach magnitudes well in excess of 30,000 volts, which is the voltage where a spark to ground normally occurs. This voltage is known as the breakdown potential.

Numerous fires and explosions have been caused by static spark ignitions from charges generated in hydrocarbons during switch loading operations. Switch loading occurs when fuel is transferred from one location to another, such as from a tanker to storage tanks, from a fuel nozzle to a vehicle, and even when a fuel is sloshing around in a container. This creates the potentially explosive conditions, as discussed supra. In addition, the more pure the fuel, the greater the charge build-up.

Aside from the explosive hazards associated with static electricity build up in fuel, fuel efficiency and power also is compromised. In theory the fuel is supposed to atomize into small homogenous droplets as it is injected into the intake port and/or cylinder/combustion chamber for more efficient combustion. In actuality, less efficient combustion occurs due to was is known as "Wall Wetting." Wall wetting occurs when a portion of the fuel sticks to metal surfaces of the engine, perhaps due to charged fuel being attracted to an oppositely-charged engine surface.

Wall wetting plays a significant role in the creation of carbon deposits on the intake valves, piston tops and combustion chambers. These deposits adsorb and desorb fuel during combustion. As such, this trapped fuel is not available to produce power, but rather increases carbon build-up, and also increases emissions of carbon monoxide, nitrous oxides and unburnt hydrocarbons. This additional, unburnt fuel situation is known as over-fueling.

The carbon deposits can cause an increase in the pressure of the fuel-gas mixture during the compression cycle of the piston. Also, the carbon deposits create hot spots. The increased pressure and/or the hot spot can cause the fuel-gas mixture to self ignite resulting in lost power and possible damage to the engine.

There have been many attempts and experiments to prevent flow-charging, from flowing the fuel over grounded metal plates, hanging metal chains in the liquid, to conductivity additives. U.S. Pat. No. 5,898,560, awarded to the inventors in the instant matter, includes a device inserted in a fuel line to electrically discharge a flowing hydrocarbon fuel. The device causes the fuel to contact a plurality of metallic pellets stationed inside a metallic enclosure. The metallic enclosure is grounded.

Generally, the utilization of metal substrate to disburse localized charge build-up in fuel has not proven entirely satisfactory. For example, the device disclosed in the '560 patent is expensive to fabricate, expensive to install, and removes less than 50 percent of the static charge from the flowing fuel.

Conductivity additives are available as an alternative to the use of metallic substrates to minimize static build up. While these additives do shorten the time of relaxing the fuel, they also allow the fuel to charge up faster and to greater voltages, as noted in U.S. Pat. No. 3,160,785. Indeed, these fluids have been found to actually promote static electricity build-up, as reported in Naval Research Lab (NRL) Report 8484 and Society of Automotive Engineers (SAE) Report J1645.

There are many types of fuel additives. U.S. Pat. No. 5,522,905 discloses a method whereby an exhaust filter is regenerated by adding organic compounds to diesel fuel in amounts to facilitate burn off of soot which is clogging the filter. U.S. Pat. No. 4,668,247 discloses a method whereby hydrogen energy is released by adding a catalyst to hydrocarbon fuel. U.S. Pat. No. 5,912,190 discloses the use of metal-containing organic compounds to improve the oxidation of carbonaceous products caused by diesel fuel pyrolysis. U.S. Pat. No. 6,102,975 discloses a method whereby a fuel conditioner and improver is added to a hydrocarbon fuel. None of the prior art additives address the problem of static charge in hydrocarbon fuel.

To exacerbate the problem of static build-up, certain gasoline-oxygenation compounds (namely MTBE and Ethanol) used to minimize air pollution, also are pro-static agents. Fire hazard is particularly acute with these compounds given their relatively high Reid vapor pressure (i.e., high volatility characteristics measured in psi at 100° F.).

A need exist in the art for a method and additive that reduces or eliminates static charge from hydrocarbon fuel before the fuel enters a storage vessel, thereby removing the possibility for sparks and an explosion. Also, a need exists in the art for a method and additive that reduces or eliminates static charge hydrocarbon fuels before the fuel is combined with air to generate an explosive mixture. Removal of the static charge would promote a more complete burn of the fuel with corresponding reductions in hydrocarbon particulate matter, carbon monoxide and nitrous oxide emissions to the atmosphere.

SUMMARY OF THE INVENTION

An object of the present invention is to provide a method and additive for imparting anti-static characteristics to fuel that overcomes many of the disadvantages of the prior art.

It is another object of the present invention to provide a method for removing static charge from fluid fuel. A feature of the method is mixing fuel with a substance to reduce the electrical resistance of the fuel. An advantage of the method is the realization of increased fuel flow, thereby creating the opportunity to recalibrate/tune engine air/fuel ratios for better power, fuel economy and lower emissions.

Yet another object of the present invention is to provide an additive for minimizing static charge accumulations in fluid fuel. A feature of the additive is a means for removing static charge from fuel. An advantage of the additive is the realization of a more complete burn of the fuel, resulting in decreased emissions of hydrocarbons, carbon monoxide and nitrous oxides.

Still another object of the present invention is to provide a method and additive for removing static charge from hydrocarbon fluids stored in a tank. A feature of the method and additive is the introduction of ions in the fuel so as to prevent and/or neutralize any build-up of charge in flowing fuel. An advantage of the method and additive is the reduced chance of a spark from the fluid surface to ground that would otherwise lead to an explosion.

Other objects are to reduce or simplify the components of a method and additive for removing static charge from fluid fuel; to reduce the costs to develop a method and additive for removing static charge from fluid fuel; to reduce hydrocarbon and monoxides discharged from an internal combustion engine; to cause a more complete burn of a hydrocarbon fuel; to increase the power developed by an internal combustion engine; to improve safety when transporting and storing fluid fuels; to decrease carbon deposits on the metal surfaces forming the combustion chamber of an internal combustion engine; to increase the flow rate of a non-conductive fluid fuel; to reduce the "over-fueling" of the combustion cycle of an internal combustion engine; and to provide a method and additive for discharging fluid fuel.

The present invention provides a method for imparting anti-static characteristics to fuel, the method comprising supplying a hydrocarbon fuel; and mixing the fuel with a metal ion, contained in an inorganic compound, to reduce the electrical resistance of the fuel.

DESCRIPTION OF THE DRAWING

The invention together with the above and other objects and advantages will best be understood from the following detailed description of the preferred embodiment of the invention shown in the accompanying drawing, wherein.

DETAILED DESCRIPTION OF THE INVENTION

Figure 1A:
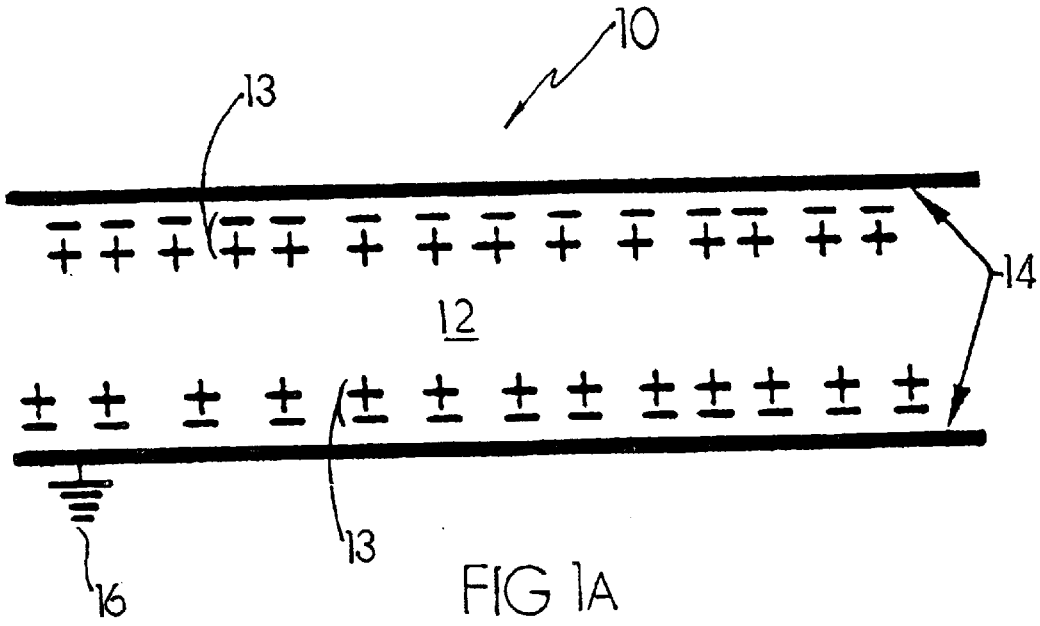
FIGS. 1A and 1B depict the phenomenon of flow charging in fuel.

The invented method and formulation decreases static charge and therefore the explosion hazards, pollution problems and wall-wetting phenomenon associated with the use of charged fuel. The method and formulation also increases the efficiency of fuel subjected to the method and/or formulation.

A salient feature of the invention is the utilization of a fuel additive to impart anti-static characteristics to fuel and/or reduce the electrical charge in fuel. This results in an electric-charge-neutralization of the fuel. The additive pretreats hydrocarbon (nonconductive fluid) fuel by introducing ions thereto to reduce the electrical resistance (i.e., increase the conductivity) of the fuel. Charge reductions of as much as 90 percent have been empirically realized. Generally, reductions of from 50 percent (2:1) to approximately 90 percent (4.5:1) are reproducible.

The additive homogeneously disburses throughout the fuel and provides a conductive "bridge" that allows varying magnitudes and/or polarities of pocket charge to combine, thereby preventing, lowering or eliminating a high voltage static charge in the fuel. This charge dispersal effect occurs whether the fuel is stationary in a tank or flowing through a conduit.

The present invention utilizes a liquid fuel additive that serves to treat the fuel prior to the fuel contacting the equipment utilizing the fuel. Generally, the additive is mixed with the fuel by pouring the additive into a fuel tank containing the fuel. The additive is packaged in containers of predetermined volumes.

Additive Detail

The only requirement of the substance is that it be a miscible (vis-á-vis the fuel), electrically-conductive material. The material incorporates charged moieties containing ions derived from elements from Groups I, II, IVA, VIA, and VIIA, and from Periods 2, 3, and 4 of the Periodic Table. These ions are delivered in gaseous, liquid or solid phases. The ions are contacted with the fuel as either a single phase, or a mixed phase liquor. Suitable metals include alkaline metals. Suitable metals include those selected from the group consisting of Li, K, Mg, Ca, Na, Cs, Be, Sr, Ba, and combinations thereof.

In the case of ligand involvement, ambidentate (e.g., unidentate and multidentate) ligands are utilized as metal ion delivery vehicles via chelation. Suitable ligands include, but are not limited to water, ammonia, carbon monoxide, monoatomic ions like chloride and sulfide, polyatomic ions like cyanide, carbonate, nitrate, nitrite, alkyl ligands, and allyl ligands, the last of which are particularly suitable in both the monohapto and trihapto form. For example, reductive elimination of trihapto ligands provides cations when sequestered metal is released to its environs. In this regard, the released metal is a Lewis Acid in that it accepts electrons from the fuel in instances where the fuel is "overcharged" with negative ions.

In one instance, the invented method utilizes electrolytes and/or ligands comprised of metal ions from Group I of the Periodic Table, combined with nonmetals. These electrolytes and ligands are present in the additive at from 1 to 25 moles per liter of additive. In the case of LiBr used as an additive, suitable concentrations range from 1–25 grams of LiBr to solvent.

static charge.

In the case of introducing ions in a solids configuration, compounds selected from the group consisting of LiBr, KBr, MgBr, NaBr, CaBr, and combinations thereof, are utilized. These solids (mostly in powder form) are first solubilized in a suitable solvent before being homogeneously mixed with the subject fuel. The molar ratios as discussed in the previous paragraph are suitable powder/solvent formulations. Preferred mixtures are from 1–25 grams of powder per liter of solvent, and most preferred mixtures are from 1–4 grams of powder per liter of solvent. These powdered compounds are widely commercially available from such suppliers as FMC (Gastonia, N.C.).

Homogeneity of the powder through the substance is assured via blending of the powder with a solvent. The solvent may be polar, non-polar, inorganic, organic and combinations thereof. For example, suitable solvents include those containing an organic compound selected from the group consisting of ketone, alcohol, aldehyde, ethanol, and combinations thereof. Exemplary alcohols include methanol, ethanol, propanol and butanol. The solvent also may include water, either used alone, or in combination the organic compound classes enumerated in this paragraph.

Chemistry Detail

Figure 1B:
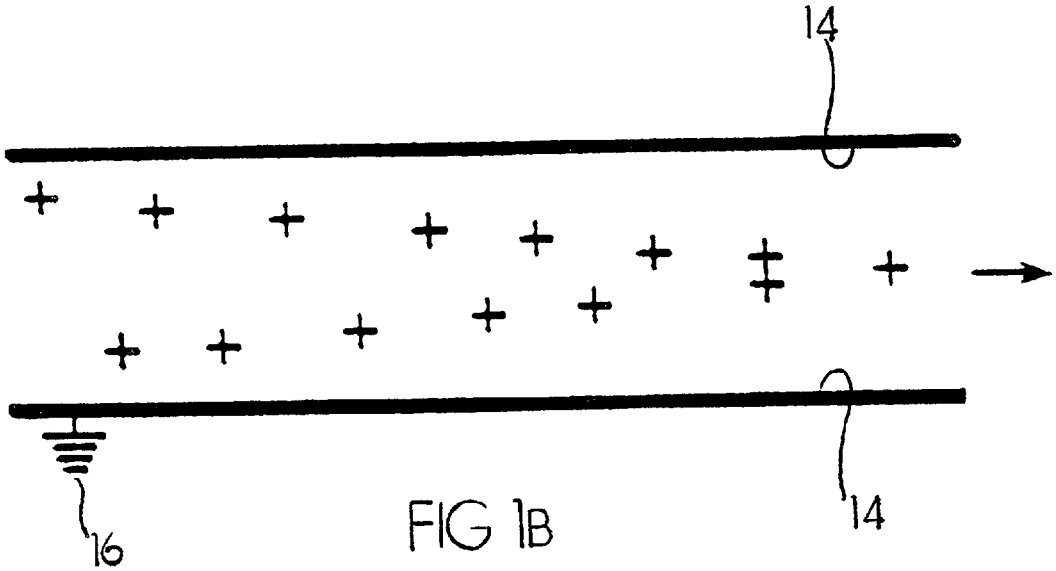
Figure 2:
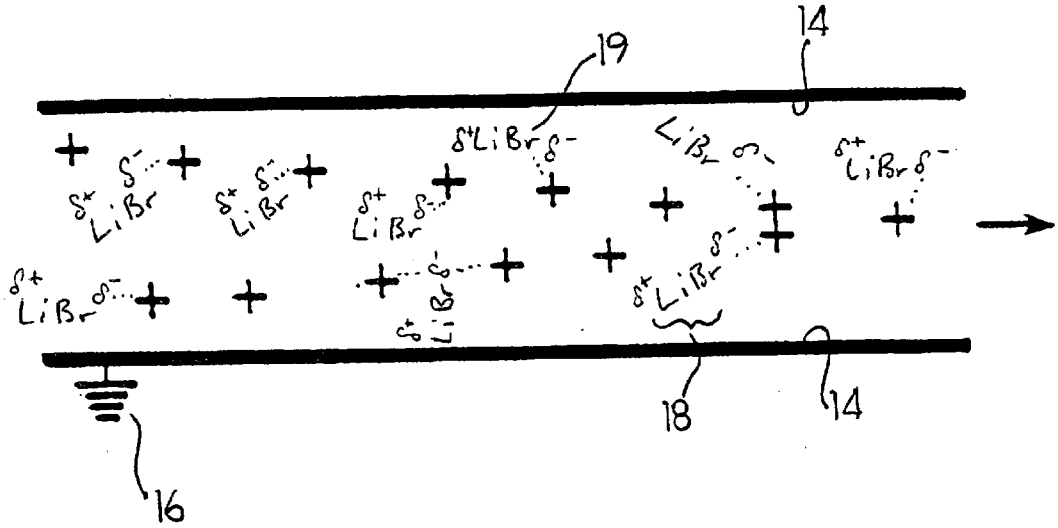
FIG. 2 depicts charge minimization in positively charged fuel, in accordance with features of the present invention.

Using LiBr as an exemplary electrolyte/additive, FIG. 2 depicts the electrolyte 18 interacting with fuel having a positive charge. In this instance, the negative portion (δ−), 19 (i.e. the Bromine atom) of the dipole moment of the salt electrostatically interacts with the positive charge carrier in the fluid (perhaps the carrier being the ionized impurity generated upon fuel flow). This bromine interaction serves to eliminate or at least minimize the net positive charge previously depicted in FIG. 1B.

Figure 3:
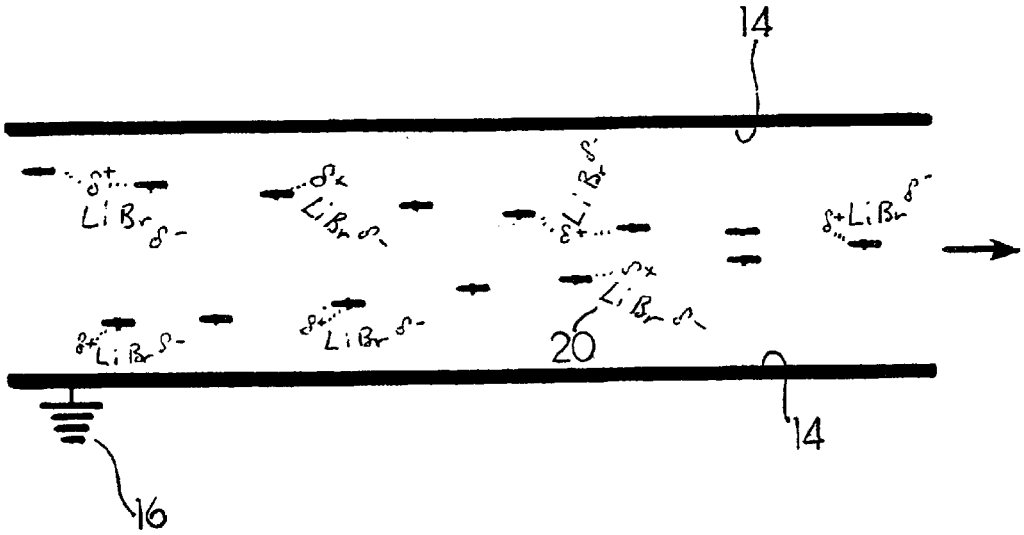
FIG. 3 depicts charge minimization in negatively charged fuel, in accordance with features of the present invention.

Electrolytes as additives are also useful to eliminate or minimize net negative charge build-up in fuel. FIG. 3 depicts the LiBr electrolyte interacting to counteract the unwanted negative charge. Specifically, the positive portion δ+, 20 (i.e., the lithium atom) of the dipole moment of the salt electrostatically interacts with the negative moieties to reduce or eliminate any negative charge loci in the flowing fuel.

As discussed supra, the additive interacts with the charged portions of the fuel in an electrostatic (noncovalent) fashion. However, reduction-oxidation interactions also occur. For example, taking LiBr as the additive, the easily oxidized lithium (and most group I and II metals) couple with anions found in charged fuel so as to form a new salt comprising the fuel anion and the metal cation. Conversely, the corresponding nonmetal anion of the salt additive cation couples with the fuel cation. Equations 1–4 below depict this redox eventuality.

$$Li \rightarrow Li^{+} + e^{-} \qquad \text{Equation 1}$$

$$Br + e^{-} \rightarrow Br- \qquad \text{Equation 2}$$

$$Li^{+} + Fuel^{-} \rightarrow LiFuel \qquad \text{Equation 3}$$

$$Br- + Fuel^{+} \rightarrow BrFuel \qquad \text{Equation 4}$$

In such a redox eventuality, a grounding source (element 16) is not required, inasmuch as the redox interactions render the fuel fluid complete charge neutral, i.e., zero The potential of water as a metal carrier is poignant, particularly as environmental regulations continue to restrict use of more typical aromatic and paraffinic solvents. Water is soluble in fuels to an extent of approximately 1 part per million (ppm) per degree Fahrenheit (F) at 100 percent relative humidity. As such, at 60 F. and 50 percent relative humidity, solubility of water is approximately 30 ppm. Small variations of this water solubility exists, depending on the relative amounts of aromatics and paraffins. Generally, aromatics dissolve more water than paraffins. Water can exist in the electrically conductive material at up to 10 percent by weight of the entire material.

The solvents listed in Table 1 are suitable carriers for the metal to form the miscible, electrically-conductive material. The solvents are arranged by the Debye Polarity at 25 degrees centigrade.

TABLE 1

Relative Electrical Polarity of Various Polar Solvents

| | |
|---|---|
| Formamide | 109.0 |
| Water | 78.5 |
| p-Nitroaniline | 56.0 |
| Acetamide | 50.0 |
| Furfural | 46.0 |
| Dimethyl Sulfoxide | 45.0 |
| Glycerol | 42.5 |
| Nitroaniline (o, m, p) | 40.0 |
| Glycol | 37.7 |
| Dimethyl Formamide | 37.0 |
| 1,3-Propanediol | 35.0 |
| Nitrobenzene | 34.8 |
| o-Nitroaniline | 34.0 |
| Methanol | 32.6 |
| 1,2-Propanediol | 32.0 |
| Benzoyl chloride | 29.0 |
| Nitroethane | 28.0 |
| o-Nitrotoluene | 28.0 |
| Acetyl acetone | 25.2 |
| 2-Chloroethanol | 25.0 |
| Ethanol | 25.0 |
| m-nitrotoluene | 23.0 |
| Ammonia | 22.4 |
| Lactic Acid | 22.0 |
| p-Nitrotoluene | 22.0 |
| 2-Propen-1-ol | 21.0 |
| Acetaldehyde | 21.0 |
| Acetone | 20.7 |
| Propanol | 20.1 |
| Benzaldehyde | 19.0 |
| Cyclohexane | 18.0 |
| 1-Butanol | 17.8 |
| Acetophenone | 17.4 |
| 2-Pentanone | 15.4 |
| 1,2-Dichloroethane | 10.4 |
| Octanol | 10.3 |

As can be noted in Table 1, water is second on the list, indicating its relatively superior solvent tendencies.

Formulation Detail

The method of the present invention utilizes a substance (additive) that is essentially an electrolyte that electrically "connects" isolated groups of electrical charge suspended in the fuel. The groups of electrical charge vary in magnitude and polarity. The vast majority of groups of electrical charge are neutralized in a relatively short time period after the fuel begins to flow thereby substantially reducing the net or average static charge of the fuel.

Inasmuch as the additive generally must facilitate charge neutralization of the target fuel, the ionic component of the additive serves to electrically counteract the static charge of the fuel. In instances where fuel is positively charged, the additive interacts with the fuel as a Lewis base, with the additive donating electrons and the fuel accepting the electrons. In instances where the fuel is negatively charged, the additive interacts with the fuel as a Lewis acid, with the additive accepting electrons donated by the fuel. The charge interaction does not necessarily result in a covalent bond between additive and fuel-impurity moieties. Electrostatic interaction, via the dipole interactions depicted in FIGS. 2 and 3 are possible. Whatever the ionic interaction, the proven net result is a charge neutralization of the fuel (See Example below).

Adding a portion of a predetermined quantity of the substance to a fuel tank followed by more fuel enhances the mixing process thus increasing the number of neutralized groups of electrical charge.

When solid-phase ionic moiety material is utilized (usually provided as a powder, commercially available, the solid phase is present in the solvent in a weight of between 0.0001:1.0 to 0.01:1.0 powder:solvent. A preferable ratio is approximately 1 gram per liter of solvent.

The resulting electrolyte solution (heretofore referred to the fuel-miscible, electrically-conductive material) is present in the fuel in a volume percent of between 0.0001 to 0.01. Solvents such as alcohol or ketone can be present with water in a volume ratio of between 0.1% to 99.5%. The ligand is present in the fuel in a volume percent of between 0.0001 to 0.01.

EXAMPLE 1

The seemingly intractable problem of charged fuel has heretofore compelled automotive engineers to rely on high pressure fuel delivery systems for today's modern engines. However, these high pressure systems cause piston over-fueling, resulting in carbon deposits and increased pollutants.

The inventors have discovered that when the charge buildup in the fuel is reduced and/or eliminated, fuel flow is improved significantly in these same engines, and as such, the engines can be leaned-out to, leading to increased fuel efficiency and less pollution.

In one instance, Dynamometer testing was done with carbureted engines tuned to maximum performance. Upon addition of the invented anti-static additive, the engines were tested again. The results showed a loss of power and torque but a significant increase in fuel flow. When the air/fuel mixture of these high performance settings were then re-jetted to accommodate a leaner mixture, higher power was obtained, compared to the power exhibited by a standard engine burning unadulterated (i.e. charged) fuel.

Similar tests have been conducted on motor vehicles with modern engine management systems. The results show increases in fuel economy, engine performance and emission reductions.

Specifically, Texaco 87 Octane gasoline without the additive has a resistance of 1.9 E+12 Ohm-cm and a charge of 6.35 E-13 Coulomb/ml. One gallon of Texaco 87 Octane gasoline combined with one milliliter of Additive has a resistance of 8.2 E+11 Ohm-cm and a charge of 1.40 E-13 coulomb/mi.

The additive had no detrimental effect on the energy component of the gasoline. In fact, the reduction of static charge corresponded to an increase in horsepower in internal combustion engines having combustion chamber carbon build-up, an increase in mileage of about twelve percent and a reduction in hydrocarbon and carbon monoxide emissions of at least five percent.

While the invention has been described with reference to the details of the embodiment, these details are not intended to limit the scope of the invention as defined in the appended claims.

What is claimed is:

1. A method for imparting anti-static characteristics to fuel, the method comprising supplying a hydrocarbon fuel; and mixing the fuel with metal ion to reduce the electrical resistance of the fuel, the step of mixing the fuel with metal ion being preceded by solubilizing a salt containing the metal ion with a solvent, the salt-solvent weight ratio being between 0.0001:1.0 to 0.01:1.0 salt:solvent.

2. The method as recited in claim 1 wherein the metal ion is contained in a salt selected from the group consisting of LiBr, KBr, MgBr, and combinations thereof.

3. The method as recited in claim 1 wherein the ion is contained in a coordination complex containing a metal selected from the group consisting of Li, K, Mg, Ca, Na, Cs, Be, Sr, Ba, and combinations thereof.

4. The method as recited in claim 1 wherein the metal comprises an alkaline metal.

5. The method as recited in claim 1 wherein the solvent is an organic compound selected from the group consisting of a ketone, an alcohol, an aldehyde, and combinations thereof.

6. A method for reducing the electrical charge in fuel, the method comprising supplying a hydrocarbon fuel, and adding a metal salt solution to said hydrocarbon fuel, the solution comprising a salt present in a solvent in a weight ratio of between 0.0001:1.0 to 0.01:1.0 salt:solvent.

7. A method for reducing the electrical charge in fuel, the method comprising supplying a hydrocarbon fuel, and adding a metal salt solution to said hydrocarbon fuel, the salt solution is present in the fuel in a volume percent of between 0.0001 to 0.01, the solvent is a liquid selected from the group consisting of an alcohol, a ketone, an aldehyde, and combinations thereof, the alcohol is present with water in a volume ratio of between 0.1% to 99.5%, the ketone is present with water in a volume ratio of between 0.1% to 99.5%.

8. A method for increasing combustion characteristics of a fuel, the method comprising supplying a hydrocarbon fuel; and minimizing static electricity accumulations in the fuel prior to combustion, the minimized static electricity accumulations being between approximately 22 percent and 50 percent of the original charge.

9. The method recited in claim 8 wherein the step of minimizing static electricity includes the step of adding a metal salt solution to said hydrocarbon fuel.

10. The method as recited in claim 9 wherein the metal salt solution comprises a salt present in a solvent.

11. The method as recited in claim 10 wherein the solvent is a liquid selected from the group consisting of an alcohol, a detone, and aldehyde, and combinations thereof.

12. The method as recited in claim 8 wherein the step of minimizing static electricity charge includes the step of mixing said hydrocarbon fuel with a salt selected from the group consisting of LiBr, KBr, MgBr, and combinations thereof.

13. The method as recited in claim 8 wherein the step of minimizing static electricity charge includes the step of adding a coordination complex containing a metal selected from the group-consisting of Li, K, Ca, Na, Be, Cs, Sr, Ba, and combinations thereof.

14. The method as recited in claim 13 wherein the coordination complex is present in the fuel in a volume percent of between 0.0001 to 0.01.

15. The method as recited in claim 8 wherein the step of minimizing static electricity accumulations comprises electrically connecting the accumulations to each other via a solubilized metal.

16. A substance to decrease static charge in ligand fuels, the substance comprising an alkaline metal homogeneously disbursed throughout electrically non-conductive fuel, the static electric charge is decreased between approximately 22 percent and 50 percent of the original charge.

17. The substance as recited in claim 16 wherein the alkaline metal is present in the fuel in weight ratio of between 0.0000078:1.0 to 0.01:1.0.

* * * * *